US006357804B1

(12) United States Patent
Bernier et al.

(10) Patent No.: US 6,357,804 B1
(45) Date of Patent: Mar. 19, 2002

(54) DOOR LATCH FOR ELECTRICAL EQUIPMENT ENCLOSURE

(75) Inventors: Richard E. Bernier; Gilbert A. Soares, both of Mebane; James H. Cook, Wilmington, all of NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/459,776

(22) Filed: Dec. 13, 1999

(51) Int. Cl.[7] ..... E05C 5/00
(52) U.S. Cl. ..... 292/114; 292/67
(58) Field of Search ..... 292/67, 109, 110, 292/111, 114, 128, 202, 210, 129, DIG. 37, DIG. 65; 49/141

(56) References Cited

U.S. PATENT DOCUMENTS

| | | | | | |
|---|---|---|---|---|---|
| 849,207 | A | * | 4/1907 | Cox | 292/128 |
| 927,240 | A | * | 7/1909 | Hoffman | 292/78 |
| 1,521,699 | A | * | 1/1925 | Massuger | 292/124 |
| 1,664,576 | A | * | 4/1928 | Stuart | 292/127 |
| 1,692,295 | A | * | 11/1928 | Gerard | 292/242 |
| 1,822,110 | A | * | 9/1931 | Raymond | 292/60 |
| 2,603,511 | A | * | 7/1952 | Schatzman | 292/114 |
| 2,670,981 | A | * | 3/1954 | Wenham | 292/114 |
| 3,402,958 | A | * | 9/1968 | Barry | 292/62 |
| 3,482,143 | A | * | 12/1969 | Stark | 317/120 |
| 4,337,972 | A | * | 7/1982 | Gill | 292/67 |
| 4,586,736 | A | * | 5/1986 | Dougherty | 292/202 |
| 5,791,701 | A | * | 8/1998 | Daoud | 292/129 |
| 5,927,766 | A | | 7/1999 | Rosen | |

* cited by examiner

*Primary Examiner*—Gary Estremsky
(74) *Attorney, Agent, or Firm*—Cantor Colburn LLP

(57) ABSTRACT

A door latch for latching a door of an electrical equipment enclosure includes a latch body and a latch rod rotatable between locked and unlocked conditions. The latch rod includes a stem with a first end rotatably coupled to the latch body, an extension rod with a first end coupled to a second end of the stem, and a hook coupled to a second end of the extension rod. The extension rod is dimensioned to contact a portion of the electrical equipment enclosure when the latch rod is in the locked condition. The hook is separated from the portion of the electrical equipment enclosure by a clearance distance "x" during a quiescent condition within the electrical enclosure. The hook contacts the portion of the electrical equipment enclosure during a pressurized condition within the electrical equipment enclosure. The clearance distance "x" is selected to provide a clearance distance "y" between the door and the enclosure to allow pressurized gas to escape the enclosure during the pressurized condition.

16 Claims, 3 Drawing Sheets

DOOR LATCH FOR ELECTRICAL EQUIPMENT ENCLOSURE

BACKGROUND OF THE INVENTION

This invention relates to a door latch for an electrical equipment enclosure. In particular, this invention relates to a flexible door latch which can prevent the door of an electrical equipment enclosure from being forced open during a short circuit overcurrent condition without requiring bolts within the latch.

Electrical equipment enclosures such as those containing, for example, a motor starter, electric switch and a circuit breaker, require durable latches to prevent the enclosure door from blowing open under the arc gas pressure generated upon occurrence of a short-circuit overcurrent condition within any of the enclosed electric equipment. Such latches are often cumbersome due to the mechanical structure needed to withstand the explosive forces generated by the arc pressure on the enclosure door such that some time is required to unlatch the door during routine mechanical maintenance of the enclosed equipment.

One example of a door latch containing a pawl member bolted to a rotatable member is described within U.S. Pat. No. 5,927,766 entitled "Latching Mechanism for a Motor Control Center."

It would be advantageous to provide a pair of compact latches to the door of a motor control center to allow a controlled outwards expansion of the door during intense short-circuit overcurrent conditions to allow arc pressure gas venting while maintaining the door in a virtually closed condition. However, the cumbersome prior door latches have made providing such a pair of latches on a single door significantly expensive in material, time, and labor.

BRIEF SUMMARY OF THE INVENTION

In an exemplary embodiment of the invention, a door latch for latching a door of an electrical equipment enclosure includes a latch body and a latch rod rotatable between locked and unlocked conditions. The latch rod includes a stem with a first end rotatably coupled to the latch body, an extension rod with a first end coupled to a second end of the stem, and a hook coupled to a second end of the extension rod. The extension rod is dimensioned to contact a portion of the electrical equipment enclosure when the latch rod is in the locked condition. The hook is separated form the portion of the electrical equipment enclosure by a clearance distance "x" during a quiescent condition within the electrical enclosure. The hook contacts the portion of the electrical equipment enclosure during a pressurized condition within the electrical equipment enclosure. The clearance distance "x" is selected to provide a clearance distance "y" between the door and the enclosure to allow pressurized gas to escape the enclosure during the pressurized condition.

DETAILED DESCRIPTION OF THE INVENTION

Figure 1:
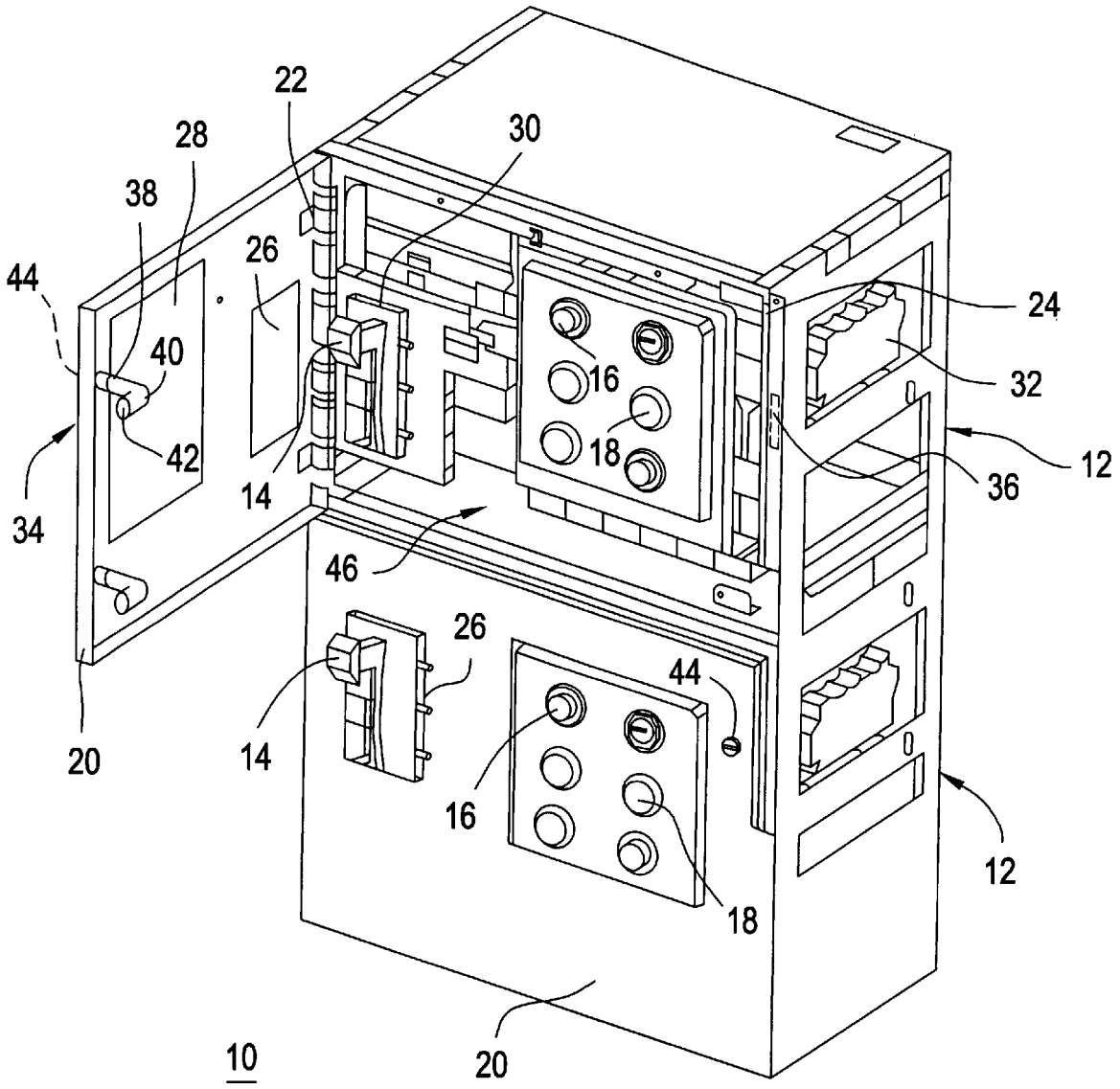
FIG. 1 is a top perspective view of a motor control center employing the flexible latch arrangement of the present invention.

A motor control center 10 is shown in FIG. 1 with a pair of enclosures 12, one over the other containing a circuit breaker 30, motor controller unit 46 and switches 32. The operating handle 14, for manually turning the circuit breaker 30 between ON and OFF conditions, extends through the slot 26 formed in the access door 20 and the indicator lamps 16 and control buttons 18 for the motor controller unit are accessible via the slot 28. The door 20 is attached to the enclosure 12 by means of a pair of hinges, one of which is indicated at 22. In accordance with the invention, a pair of compact door latches, one of which is indicated at 34, interacts with a corresponding pair of slots, one of which is indicated at 36, formed in the door frame 24. The flexible latch 34 is accessible from the exterior of the door 20 by means of the push button 44 that interconnects with the hook end 42 via the latch body 38 and clamp or latch rod 40 as best seen by referring now to the flexible door latch 34 shown in FIG. 2.

Figure 2:
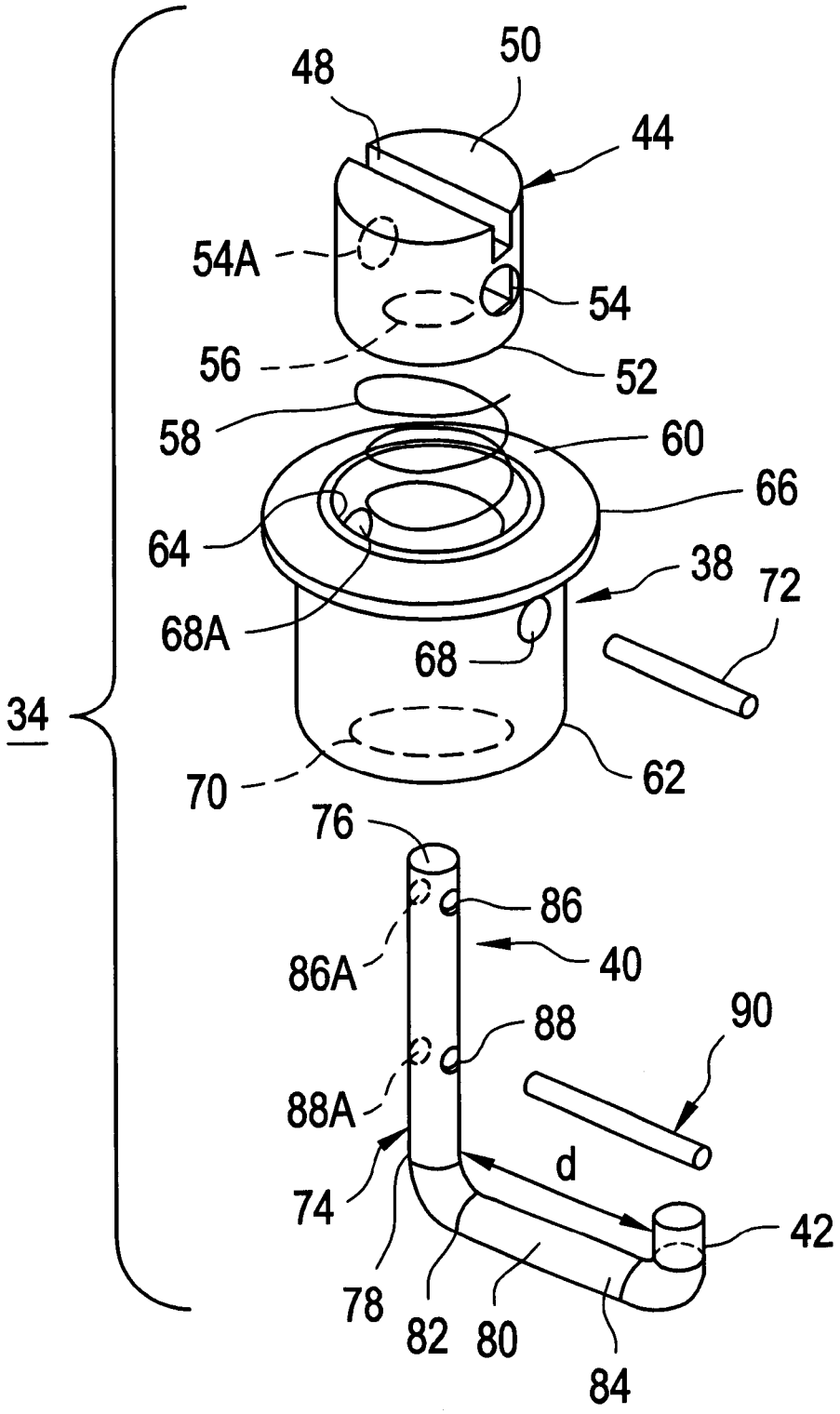
FIG. 2 is an enlarged top perspective view of the latch arrangement of FIG. 1 with the components in isometric projection.

The flexible door latch 34 in FIG. 2 consists of a circular push button 44 having a first end 50 and a second end 52. The first end 50 of the push button 44 has a tool insert slot 48 for rotating the door latch between OPEN and CLOSED positions. The push button 44 is positioned over a compression spring 58 within the interior 64 of the latch body 38. The latch body 38 has a perimetric rim 66 on its first end 60, and a pair of openings 68, 68A in the sides thereof. The perimetric rim 66 has an outer diameter greater than an outer diameter of the latch body 38 for retaining the latch 34 on door 20.

The latch rod 40 includes a stem 74, and elongated rod 80, and a hook end 42. The stem 74 has a first end 76 and a second end 78. The elongated rod 80 has a first end 82 connected to the second end 78 of the stem 74 and a second end 84 connected to the hook end 42. The stem 74 on the latch rod 40 extends through the opening 70 on the second end 62 of the latch body 38, concentric with the spring 58 up through the opening 56 in the second end 52 of the push button 44. The stem 74 of the latch rod 40 is connected with the push button 44 by inserting the pin 72 through aligned apertures 86, 86A, in the stem 74 and apertures 54, 54A in the push button 44. The latch rod 40 is next attached to the latch body 38 by inserting the pin 90 through apertures 88, 88A in the stem 74 such that pin 90 is positioned beneath the second end 62 of latch body 38.

A predetermined distance d between the hook end 42 and the second end 78 of the stem 74 determines the maximum distance the door 20 can bow outwardly and vent arc gases during a short circuit overcurrent condition. A further feature of the invention is the tubular configuration of the latch rod 40 which prevents damage to the enclosure during such an overcurrent condition, as will be discussed.

Figure 3:
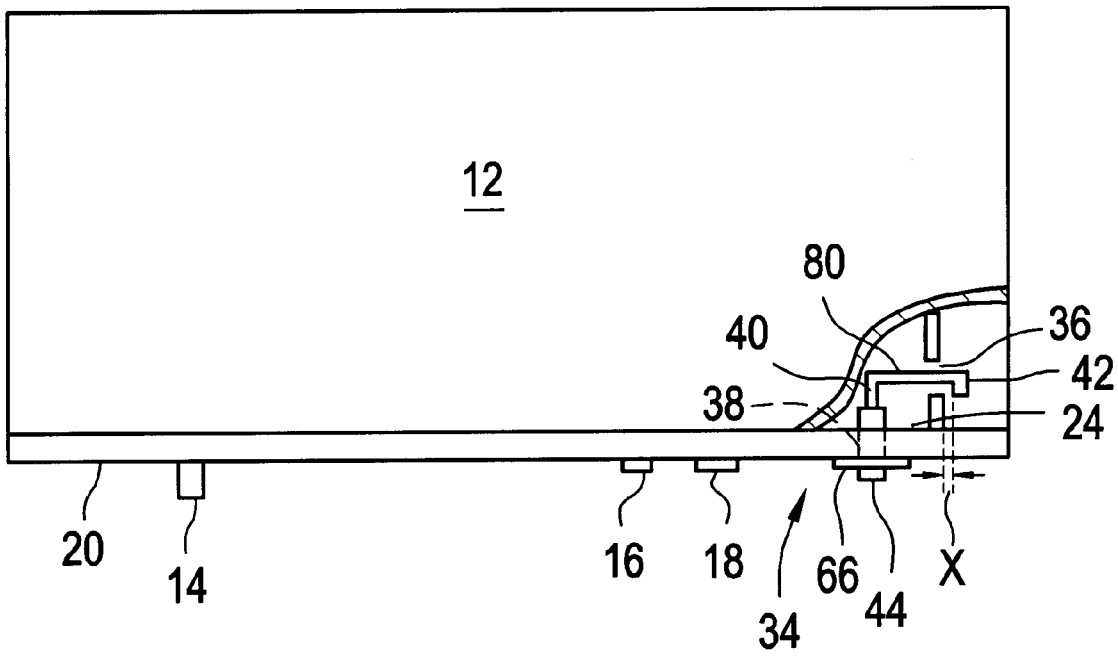
FIG. 3 is a top view of the motor control center of FIG. 1 with a part of the top of the enclosure removed to depict the latch arrangement during quiescent circuit conditions within the motor control center.

The enclosure 12 is shown in FIG. 3 with the operating handle 14, indicator lamps 16, control buttons 18 and latch push button 44 extending through the door 24. The door latch 34 is shown herein with the circuit breaker 30, motor controller 46 and switches 32 of FIG. 1 in quiescent current conditions. The rim 66 of the door latch 34 abuts preferably flush against exterior of the door 20 with the latch body 38 extending through the door 20 such that the latch rod 40, extension rod 80 and hook end 42 extend within the enclosure 12. In the locked condition shown, part of the extension rod 80 and the hook end 42 pass through the latch slot 36, with a clearance distance x between the hook end 42 and the adjacent edge of the door frame 24. Should the door 20 need to be opened, a tool could be inserted in the tool insert slot 48 of the push button 44, pushed to further compress the spring 58, and rotated a quarter turn or 90 degrees to move the hook end 42 out of the latch slot 36 enabling the door 20 to be freely opened.

Figure 4:
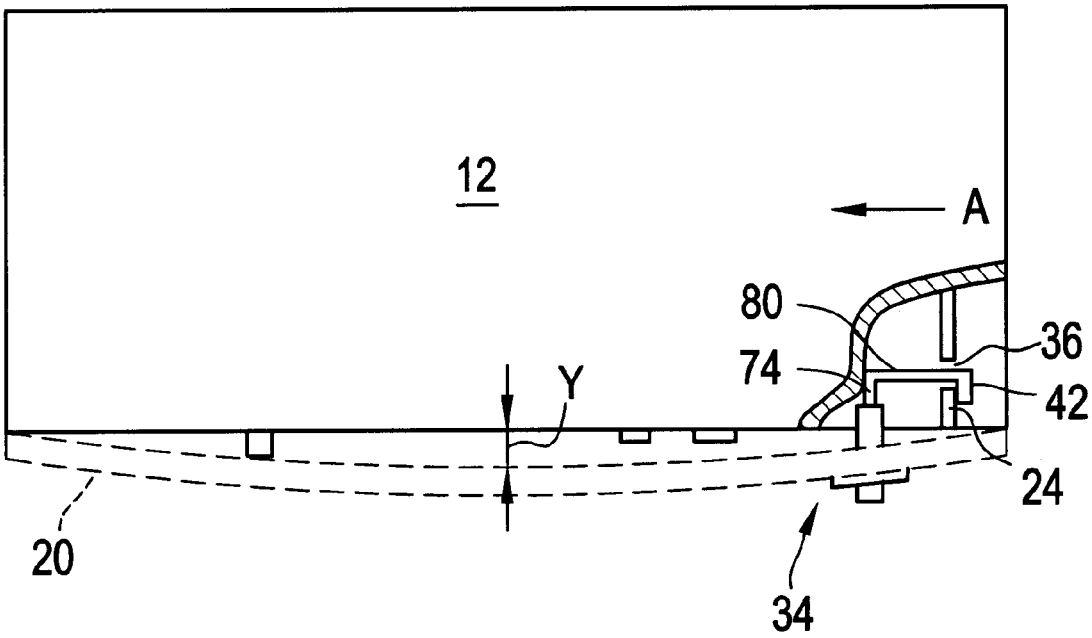
FIG. 4 is a top view of the motor control center of FIG. 3 during a short-circuit overcurrent condition within the motor control center.

In the locked condition of the door latch 34, upon occurrence of a short-circuit overcurrent condition within any of the aforementioned circuit breaker, motor controller or switches, the cover 20 of the enclosure 12 moves to the position indicated in phantom in FIG. 4. The extension rod 80 of the door latch 34 moves in direction A within the slot 36 allowing the hook end 42 at the end of the extension rod 80 to contact the adjacent edge of the door frame 24 and prevent the door 20 from further outward movement. The tubular configuration of the extension 80 on the stem 74 allows the latch rod 40 to move along the slot 36 without damaging the slot surface. The clearance between the door 20 and the enclosure 12, as indicated at y, allows the arc gases to vent through the clearance from the top and bottom of the door 20 in a direction parallel to the door and away from the front surface thereof. The release of the arc gases prevents the door 20 from being forced open at the time of the short circuit occurrence. After the arc gases have been vented, the door 20 returns to its natural state shown in FIG. 3, and the door latch 34 remains fully latched until manually opened.

A flexible door latch for electrical equipment enclosures has herein been described having means for venting the enclosure upon occurrence of a short-circuit condition. The modular component parts are interconnected together without requiring bolts or the like and, therefore, a plurality of door latches can be installed on the same enclosure door without a substantial cost increase. Furthermore, the door may expand a predetermined controlled distance for venting the arc gases during short circuit and return to a fully latched position without manual intervention.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A door latch for latching a door of an electrical equipment enclosure, the door latch comprising:

a latch body;

a latch rod rotatable between locked and unlocked conditions, said latch rod including:

a stem with a first end rotatably coupled to said latch body, an extension rod with a first end coupled to a second end of said stem, said extension rod is dimensioned to contact a portion of the electrical equipment enclosure when said latch rod is in said locked condition, a hook coupled to a second end of said extension rod, said hook is separated from said portion of the electrical equipment enclosure by a clearance distance "x" during a quiescent condition within the electrical enclosure, and wherein said hook contacts said portion of the electrical equipment enclosure during a pressurized condition within the electrical equipment enclosure, said clearance distance "x" is selected to provide a clearance distance "y" between the door and the enclosure to allow pressurized gas to escape the enclosure during said pressurized condition;

a pushbutton disposed in said latch body, said pushbutton is coupled to said first end of said stem; and a compression spring intermediate said push button and said latch body.

2. The door latch of claim 1 wherein said push button is attached to said stem by means of a first pin extending through said push button and said stem.

3. The door latch of claim 1 wherein said latch rod has a circular cross-section.

4. The door latch of claim 1 wherein said push button includes a tool insert slot.

5. The door latch of claim 1 including a perimetric rim on a first end of said latch body, said rim extending beyond an outer diameter of said latch body for retaining said latch on the door.

6. An electrical equipment center comprising:

an enclosure;

a door;

a door latch disposed on said door for securing said door to said enclosure, said door latch including:

a latch rod rotatable between locked and unlocked conditions, said latch rod including a stem with a first end rotatably coupled to said door, an extension rod with a first end coupled to a second end of said stem, said extension rod is dimensioned to contact a portion of said enclosure when said latch rod is in said locked condition, and a hook coupled to a second end of said extension rod, said hook is separated from said portion of said enclosure by a clearance distance "x" during a quiescent condition within said enclosure; and wherein said hook contacts said portion of said enclosure during a pressurized condition within said enclosure, said clearance distance "x" is selected to provide a clearance distance "y" between the door and the enclosure to allow pressurized gas to escape said enclosure during said pressurized condition.

7. The electrical equipment center of claim 6 further including:

a latch body coupled to said door;

a push button disposed within said latch body, said push button is coupled to said first end of said stem; and a compression spring intermediate said push button and said latch body.

8. The electrical equipment center of claim 7 wherein said push button is attached to said latch rod by means of a first pin extending through said push button and said latch rod.

9. The electrical equipment center of claim 7 whereon said latch body comprises a perimetric rim, the rim having a diameter greater than an outer diameter of said latch body, the rim lying flush against said door.

10. The electrical equipment center of claim 6 wherein said latch rod has a circular cross-section.

11. The electrical equipment center of claim 6 further comprising at least one electrical device, and wherein said pressurized condition is caused by a short-circuit overcurrent condition within said at least one electrical device.

12. The electrical equipment center of claim 11 wherein said at least one electrical device is selected from a group including a motor controller, a circuit breaker, and an electric switch.

13. The electrical equipment center of claim 6 wherein rotation of the push button 90 degrees transports the door between said locked and unlocked conditions.

14. An electrical equipment enclosure comprising:

a frame;

a door configured to flex upon a pressurized condition within the enclosure;

a door latch disposed on said door for securing said door to said frame, said door latch including:

a latch rod rotatable between locked and unlocked conditions, said latch rod including a stem with a first end rotatably coupled to said door, an extension rod with a first end coupled to a second end of said stem, said extension rod is dimensioned to contact said frame when said latch rod is in said locked condition, and a hook coupled to a second end of said extension rod, said hook is separated from said frame by a clearance distance "x" when said latch rod is in said locked condition; and wherein said hook contacts said frame during said pressurized condition within the enclosure to retain said door in a closed position, said clearance distance "x" is selected to limit flexure of said door during said pressurized condition.

15. The electrical equipment enclosure of claim 14, wherein said door latch further includes:

a latch body coupled to said door;

a push button disposed within said latch body, said push button is coupled to said first end of said stem; and a compression spring intermediate said push button and said latch body.

16. The electrical equipment center of claim 14 further comprising at least one electrical device, and wherein said pressurized condition is caused by a short circuit overcurrent condition within said at least one electrical device.

* * * * *